United States Patent [19]

Bosich

[11] Patent Number: 4,668,121

[45] Date of Patent: May 26, 1987

[54] PROCESS OF MAKING MATERIAL FOR AND CONSTRUCTING A ROAD

[76] Inventor: Joseph F. Bosich, 9405 Brakeman Rd., Chardon, Ohio 44024

[21] Appl. No.: 776,211

[22] Filed: Sep. 16, 1985

[51] Int. Cl.[4] ..... E01C 7/00; E02D 3/00

[52] U.S. Cl. ..... 404/72; 404/75; 404/17

[58] Field of Search ..... 404/17, 72, 71, 75, 404/32; 524/705; 428/489; 106/273 R; 521/83; 427/138; 52/169.11; 165/45; 166/901

[56] References Cited

U.S. PATENT DOCUMENTS

| | | | |
|---|---|---|---|
| 2,313,199 | 3/1943 | Heyning | 404/75 |
| 2,861,895 | 11/1958 | Hardman | 521/83 |
| 3,791,443 | 2/1974 | Burt et al. | 166/901 |
| 3,818,711 | 6/1974 | Condo et al. | 404/72 |
| 3,909,474 | 9/1975 | Borchert et al. | 404/17 |
| 3,986,781 | 10/1976 | Condo et al. | 166/901 |
| 4,137,198 | 1/1979 | Sachs | 521/83 |

*Primary Examiner*—Stephen J. Novosad
*Assistant Examiner*—Bruce M. Kisliuk
*Attorney, Agent, or Firm*—Tarolli, Sundheim & Covell

[57] ABSTRACT

A process fo making materials for road construction includes separating water from oil well drilling mud or other waste material sludge to form a partially dried sludge. The partially dried sludge is subjected to heat to further to dry the sludge. The dried sludge is combined with an open cell aggregate in pug mill to form a product. This product has a thermal conductivity of approximately 0.36 B.t.u./(hr.)(sq. ft.)(deg.F./ft.). The product is then deposited over frozen ground during the construction of a road.

5 Claims, 2 Drawing Figures

PROCESS OF MAKING MATERIAL FOR AND CONSTRUCTING A ROAD

BACKGROUND OF THE INVENTION

The present invention relates to a new and improved method of forming an improved product for making a road which extends over frozen ground.

In artic and subartic regions, permafrost underlies the surface of land areas where roads are to be built. In order to prevent thawing of the permafrost and the attendant instability, five foot or thicker layers of gravel have been provided to insulate the permafrost. Since the use of relatively large amounts of gravel is both costly and, in certain instances, detrimental to the environment from which the gravel is obtained, it has been suggested that styrene boards be used to reduce the amount of gravel required to insulate a road from the permafrost.

During oil well drilling operations, drilling muds are a waste product. Due to the materials commonly found in drilling muds, disposing of oil well drilling mud without damaging the environment has presented difficulties.

BRIEF SUMMARY OF THE INVENTION

The present invention provides a method of using drilling mud and/or other waste sludges to form a product which is suitable for use in construction of roads and which has a relatively low thermal conductivity. The low thermal conductivity of the product enables a relatively small thickness of the product to be used as an insulation barrier to protect the permafrost when a road is to be built in an artic or subartic region. Of course, the product could be used for other purposes than building roads, for example, as oil well drilling pads, airport runways, or insulation in buildings.

The product is formed by taking oil well drilling mud or other waste sludges and separating the water from the waste sludge. The partially dried sludge is then subjected to heat to further dry the sludge. The dried sludge is combined with an open cell aggregate in a pug mill to form a product. The open cell aggregate retains any oils in the product. The product has a thermal conductivity between 0.30 and 0.50 B.t.u./(hr.)(sq.ft.)(deg.F./ft.) so that a relatively small thickness of the product provides an effective insulation barrier. The product is then deposited over frozen ground to form a road.

Accordingly, it is an object of this invention to provide a new and improved process of making material for and constructing a road over frozen ground wherein the material is made from waste sludge and has a relatively low thermal conductivity.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
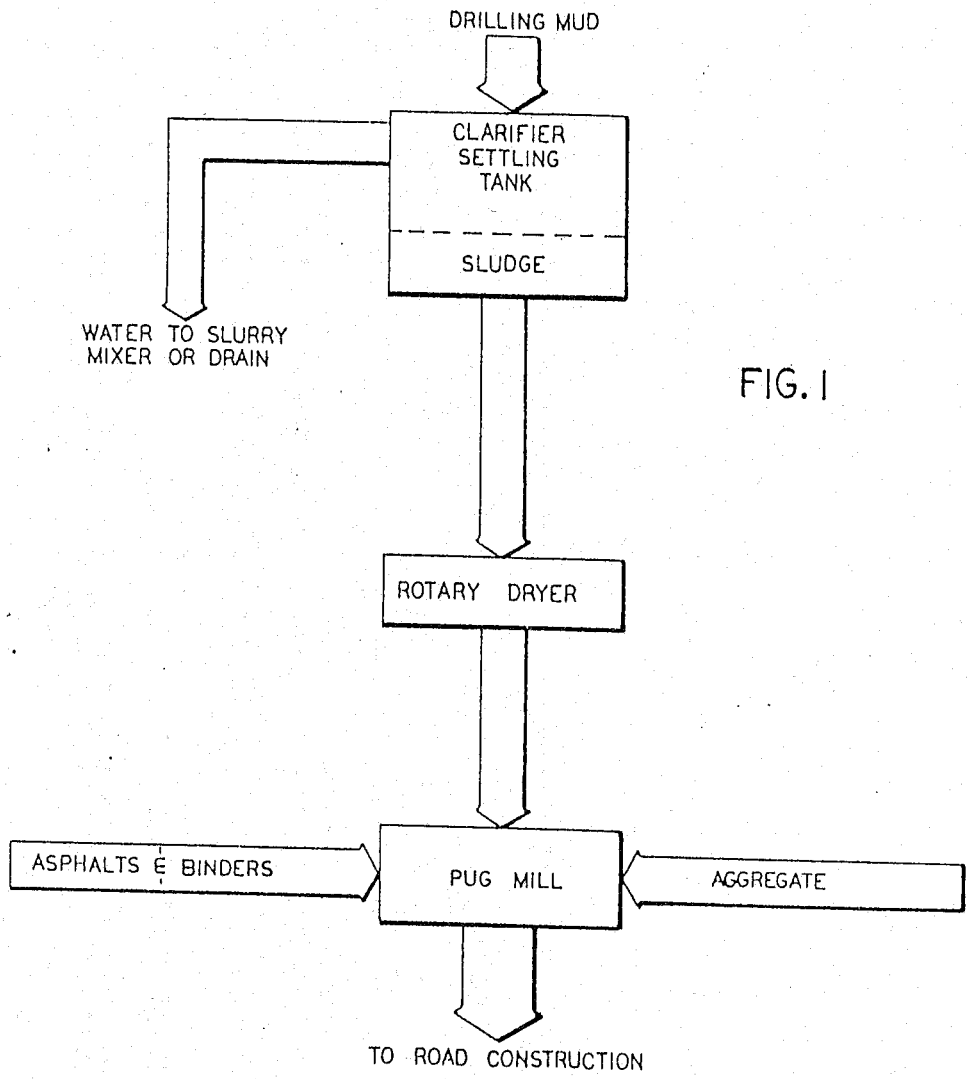
FIG. 1 is a flow chart schematically depicting the manner in which an improved product of the present invention is formed.

An improved road construction product is formed from oil well drilling muds or other waste sludges. In forming the product, the oil well drilling muds are deposited in a settling tank 10 (FIG. 1). Excess water is separated from the drilling mud. The excess water is conducted to a mixer for a slurry used in other processes or to a drain. The partially dried sludge is then conducted to a rotary dryer 12 where any brines, chromates or other toxic organic chemicals are decomposed by subjecting the sludge to heat as it is agitated in the rotary dryer. When toxic materials are contained in the sludge, a polybutidiene polymer may be added to the sludge. The dried sludge which is removed from the rotary drier has a rubbery consistency. The dried sludge is expanded and conducted to a pug mill 14.

Asphalt binders are added to the dried sludge in the pug mill 14. In addition, a light weight open cell aggregate is also added to the partially dried sludge in the pug mill. One suitable open cell light weight aggregate is "Dacotherm" (trademark) sold by Diamond Shamrock Corporation. In addition to the open cell light weight aggregate, a light weight clay or sand aggregate is added to the material in the pug mill. The pug mill 14 is then operated to intermix these materials to form a road construction product. During operation of the pug mill, the aggregate is kept at a temperature between 200° and 400° F.

As a result of operating the pug mill, a light weight road construction product is formed. This product has a thermal conductivity between 0.30 and 0.50 B.t.u./(hr.)(sq.ft.)(deg.F./ft.). The average thermal conductivity will be approximately 0.36 B.t.u./(hr.)(sq.ft.)(deg.F./ft.). The relatively low thermal conductivity of the product makes it particularly well suited for use in applications where an insulation barrier is desired. The compressed unit weight of the product is about 20 to 35 lbs. per cubic foot. The compressive strength of the product is in excess of 200 lbs. per square inch. The freeze-thaw resistance of the product is in excess of 50 cycles.

Figure 2:
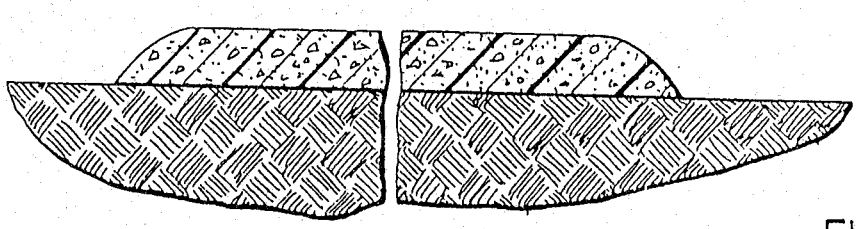
FIG. 2 is a schematic illustration depicting the manner in which the improved product is deposited over frozen ground to form a road.

Due to the relatively low cost of forming the product and the relatively low thermal conductivity of the product, the product is particularly well suited for use in road construction. Thus, when a road is formed in the manner illustrated schematically in FIG. 2, the product is deposited in a layer 18 over a bed on frozen ground 20 to form a road. Since the product has a relatively low coefficient of thermal conductivity, the layer 18 can be relatively thin. In the past, at least five feet of gravel has been used to insulate a road from the permafrost in the ground 20. When an improved product formed in accordance with the present invention is used to form the layer 18, the layer need only have a thickness of approximately 6 inches. Of course, the specific thickness of the layer 18 will vary depending upon the environment in which the layer is to be used and the operating conditions to which it is to be subjected.

In view of the foregoing description, it is apparent that the present invention provides a method of using drilling mud and/or other waste sludges to form a product which is suitable for use in construction of roads and which has a relatively low thermal conductivity. The low thermal conductivity of the product enables a relatively small thickness of the product to be used as an insulation barrier to protect the permafrost when a road is to be built in an artic or subartic region. Of course, the product could be used for other purposes than building roads.

The product is formed by taking oil well drilling mud or other waste sludges and separating the water from the waste sludge in a clarifier settling tank 10. The partially dried sludge is then subjected to heat in a rotary dryer 12 to further dry the sludge. The dried sludge is combined with an open cell aggregate in a pug mill to form a product. The open cell aggregate retains any oils in the product. The product has a thermal conductivity of approximately 0.36 B.t.u./(hr.)(sq.ft.) (deg.F./ft.) so that a relatively small thickness of the product provides an effective insulation barrier. The product is then deposited in a layer 18 over frozen ground 20 to form a road.

Having described one specific preferred embodiment of the invention, the following is claimed:

1. A process of making materials for and constructing a road over frozen ground, said process comprising separating water from waste material sludge to form a partially dried sludge, subjecting the partially dried sludge to heat to further dry the sludge, combining the dried sludge with an open cell aggregate to form a product having a thermal conductivity between 0.30 to 0.50 B.t.u./(hr.)(sq.ft.)(deg.F./ft.), and depositing the product over frozen ground to form a road.

2. A process as set forth in claim 1 wherein the waste material sludge is a drilling mud obtained from an oil well drilling operation.

3. A process as set forth in claim 1 wherein the product has a weight of approximately 20 to 35 lbs./cu.ft.

4. A process as set forth in claim 1 wherein the product has a compressive strength of at least 200 p.s.i.

5. A process as set forth in claim 1 further including combining the dried sludge and open cell aggregate with asphalt.

* * * * *